US009512975B2

(12) United States Patent
Feher Cañadell

(10) Patent No.: US 9,512,975 B2
(45) Date of Patent: Dec. 6, 2016

(54) FRAME FOR A LUMINESCENT SCREEN

(71) Applicants: Caridad Ana Descals Puig, Barcelona (ES); Marcos Feher Cañadell, Barcelona (ES)

(72) Inventor: Marcos Feher Cañadell, Barcelona (ES)

(73) Assignees: Caridad Ana Descals Puig, Barcelona (ES); Marcos Feher Cañadell, Barcelona (ES)

( * ) Notice: Subject to any disclaimer, the term of this patent is extended or adjusted under 35 U.S.C. 154(b) by 0 days.

(21) Appl. No.: 14/432,489

(22) PCT Filed: Oct. 2, 2013

(86) PCT No.: PCT/ES2013/070681
§ 371 (c)(1),
(2) Date: Mar. 31, 2015

(87) PCT Pub. No.: WO2014/053690
PCT Pub. Date: Apr. 10, 2014

(65) Prior Publication Data

US 2015/0292706 A1 Oct. 15, 2015

(30) Foreign Application Priority Data

Oct. 2, 2012 (ES) ..... 201231010 U

(51) Int. Cl.
*F21V 1/04* (2006.01)
*F21V 1/06* (2006.01)
*F21V 1/08* (2006.01)

(52) U.S. Cl.
CPC . *F21V 1/04* (2013.01); *F21V 1/06* (2013.01); *F21V 1/08* (2013.01)

(58) Field of Classification Search
CPC ..... F21V 1/06; F21V 1/04
See application file for complete search history.

(56) References Cited

U.S. PATENT DOCUMENTS 6,443,601 B1 9/2002 Wu
2004/0228132 A1* 11/2004 Sun ..... F21V 1/06 362/352

(Continued)

FOREIGN PATENT DOCUMENTS

| | | |
|---|---|---|
| DE | 202005017343 | 12/2005 |
| FR | 2445486 | 7/1980 |
| WO | WO 2014/053690 | 4/2014 |

OTHER PUBLICATIONS

International Search Report and the Written Opinion Dated Jan. 30, 2014 From the Oficina Espanola de Patentes y Marcas (Spanish Patent and Trademark Office) Re. Application No. PCT/ES2013/070681 and Its Translation Into English.

*Primary Examiner* — Elmito Breval

(57) ABSTRACT

The invention relates to a frame for a luminescent screen, comprising frame elements with a closed contour, a circular crown, and frame members consisting of profiles, the frame elements being substantially parallel to each other, the circular crown being concentric in relation to one of the frame elements, and the cap of a bulb being couplable and insertable into the circular crown. The frame elements and the circular crown are interconnected and in contact with each other by means of the frame members, and the frame elements, the circular crown, and the frame members are intercoupled by means of coupling means, said coupling means comprising a first plurality of receiving elements arranged in the frame elements and oriented towards the inside thereof, a second plurality of receiving elements arranged in the crown and oriented towards the outside thereof, and a plurality of projecting elements in the frame members, in such a way that the projecting elements are suitable for inserting and fitting into the receiving elements of the frame elements and the crown.

5 Claims, 11 Drawing Sheets

(56) References Cited

U.S. PATENT DOCUMENTS

| | | | | |
|---|---|---|---|---|
| 2005/0007787 | A1 | 1/2005 | Chou | |
| 2006/0109659 | A1* | 5/2006 | Lu | F21V 1/06 362/352 |
| 2006/0239012 | A1 | 10/2006 | Bin | |
| 2008/0158891 | A1* | 7/2008 | Lee | F21V 1/06 362/352 |

* cited by examiner

FIG. 3
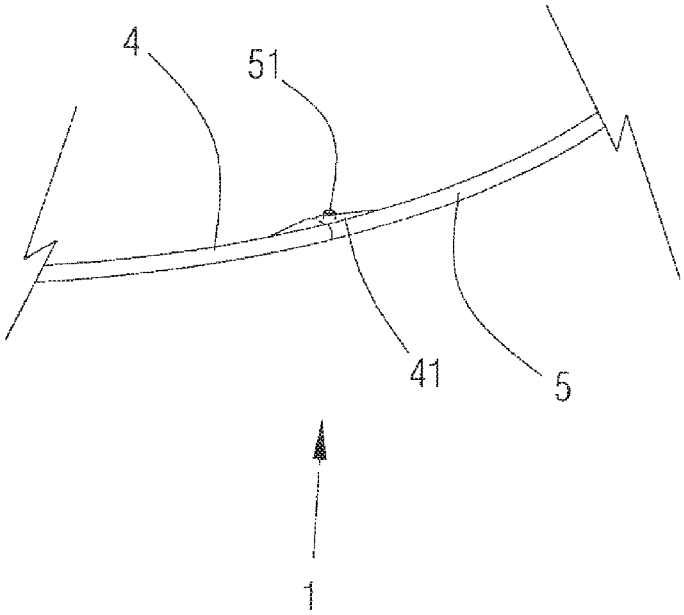
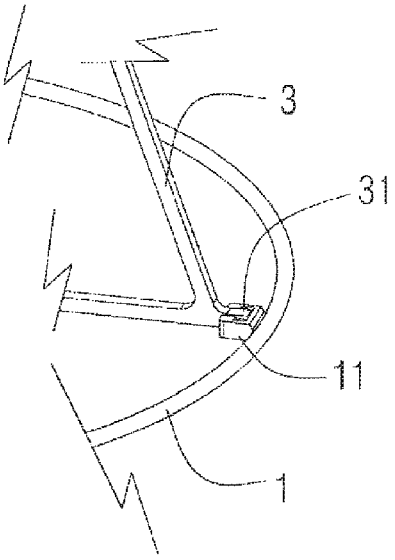
FIG. 4

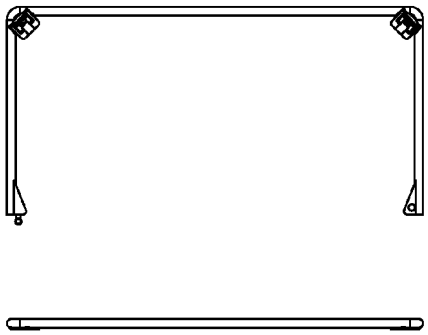
FIG.7i
FIG.7j
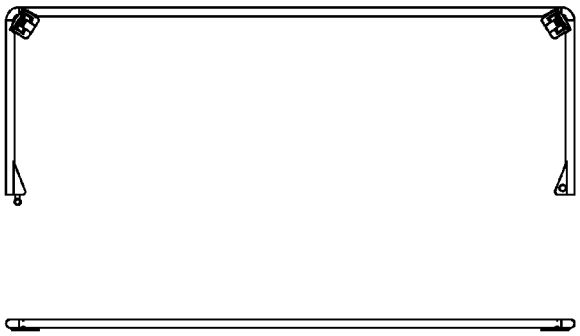

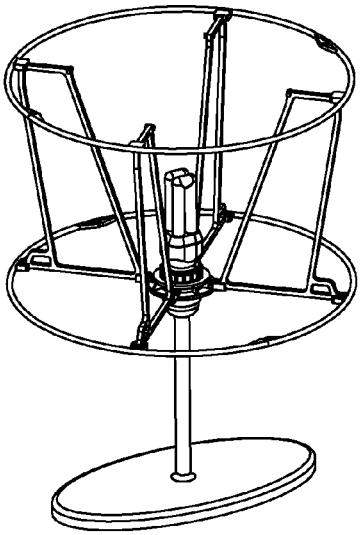
FIG.8a
FIG.8b
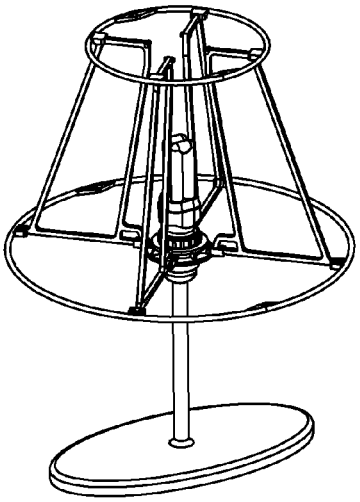
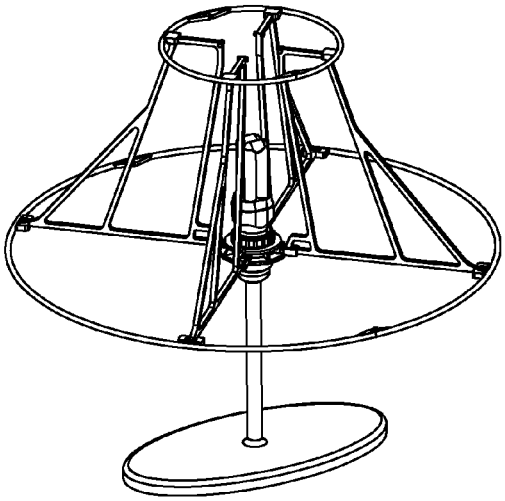
FIG.8c

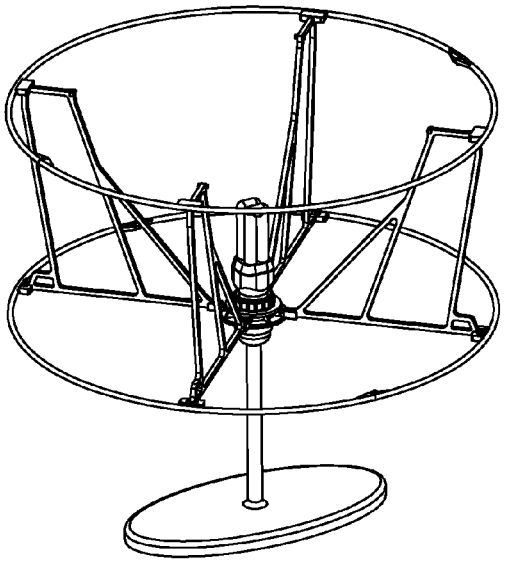
FIG.8d
FIG.8e
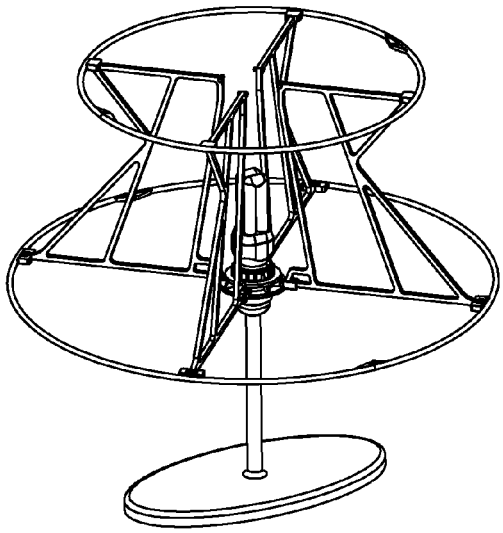

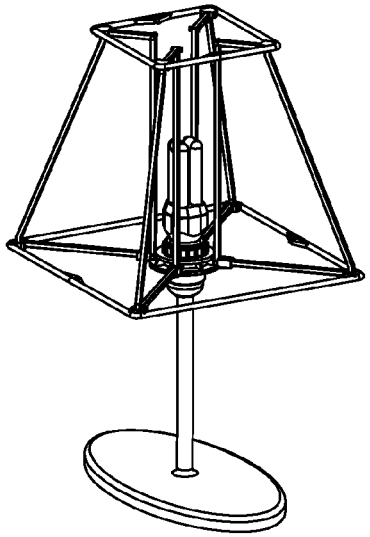
FIG.8f
FIG.8g
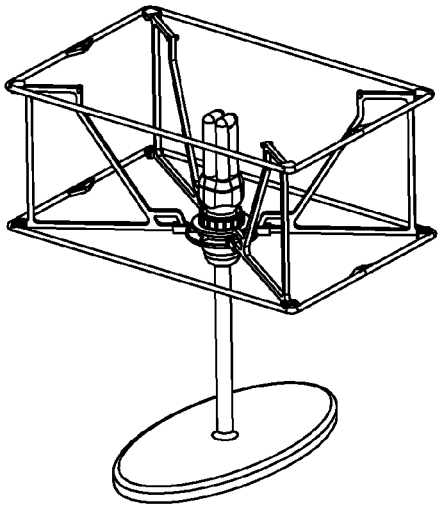

FRAME FOR A LUMINESCENT SCREEN

RELATED APPLICATIONS

This application is a National Phase of PCT Patent Application No. PCT/ES2013/070681 having International filing date of Oct. 2, 2013, which claims the benefit of priority of Spanish Patent Application No. U201231010 filed on Oct. 2, 2012. The contents of the above applications are all incorporated by reference as if fully set forth herein in their entirety.

OBJECT OF THE INVENTION

The object of this invention request is to register a frame for a luminescent screen that includes notable innovations and advantages in comparison with the techniques that have been used up to now.

More specifically, the invention proposes developing a frame for a luminescent screen, which presents the characteristics of configuration and shape similar to those of a conventional lamp; it can also be easily assembled and disassembled manually by the user and different formal features of the lamp may be selected by using in its assemblage certain integrated or other elements specific to the invention.

BACKGROUND OF THE INVENTION

Known in the current state of the art are the typical lamps that are designed for primarily domestic use in homes.

Said lamps supply the proper lighting to their surrounding space while also being used as another decorative element of the rooms they are in, which is a quality that is highly valued by their users.

For this reason it is important that the lamps meet the different needs and decorative demands of the different users, therefore providing flexibility and being adaptable to the different demands, even from a same user.

This invention contributes to finding solutions and resolving the current problems, since it allows building a frame for a luminescent screen, that is to be an integral part of a lamp, assembled and disassembled manually be the user and in a manner wherein the user himself may select the different modes of said frame, which provides different formal features to the lamp.

DESCRIPTION OF THE INVENTION

This invention has been developed for the purpose of providing a frame for a luminescent screen to resolve the aforementioned disadvantages while also providing other additional advantages that will become evident in the description that is provided below.

According to the object of the invention, the frame for a luminescent screen, comprising frame elements with a closed contour, a crown and frame members consisting of profiles, with the frame elements being substantially parallel to each other, the circular crown being concentric with respect to one of the frame elements, where the cap of a bulb can be coupled and inserted into the circular crown, and where the frame elements and the circular crown are interconnected and in contact with each other by means of frame members, and wherein the frame elements, the circular crown and the frame members are coupled to each other by means of couplings, characterized by the fact that the coupling means include a first plurality of receiving elements arranged in the frame elements and oriented towards the inside thereof, a second plurality of receiving elements arranged on the crown and oriented towards the outside thereof, and a plurality of projecting elements in the frame members, in such a way that the projecting elements are suitable for inserting and fitting into the different receiving elements of the frame elements and the crown.

Preferably the frame for a luminescent screen according to the previous claim is essentially characterized by the fact that the closed contour frames are comprised of two pieces coupled to each other, which in turn incorporate male/female connections.

As an added advantage, the frame for a luminescent screen is essentially characterized by the fact that the frames, crown and frame members are made using recycled materials.

Thanks to all the described characteristics, this invention provides the possibility of creating a frame for a luminescent screen that allows the user himself to easily and manually assemble and disassemble said frame and the user may also choose between different final structures, therefore providing different formal features to the lamp.

Other characteristics and advantages of the frame for a luminescent screen, which is an object of this invention, will become evident in the description of a preferred, although not exclusive embodiment, which is shown by way of non limiting example in the attached drawings, in which:

BRIEF DESCRIPTION OF THE DRAWINGS

FIG. 3—A detailed view of the coupling of the parts comprising the frame elements for a luminescent screen of the invention.

FIG. 4—A detailed view of the coupling between the frame and the frame members for a luminescent screen of the invention.

FIGS. 7*a*-7*j*—Are a plan and top view of the possible modalities of closed contour frame and members to be chosen by the user.

FIGS. 8*a*-8*g*—Are a view of the possible modes of the frame for a luminescent screen of the invention according to the different frames and members chosen by the user.

DESCRIPTION OF A PREFERRED EMBODIMENT

Figure 1:
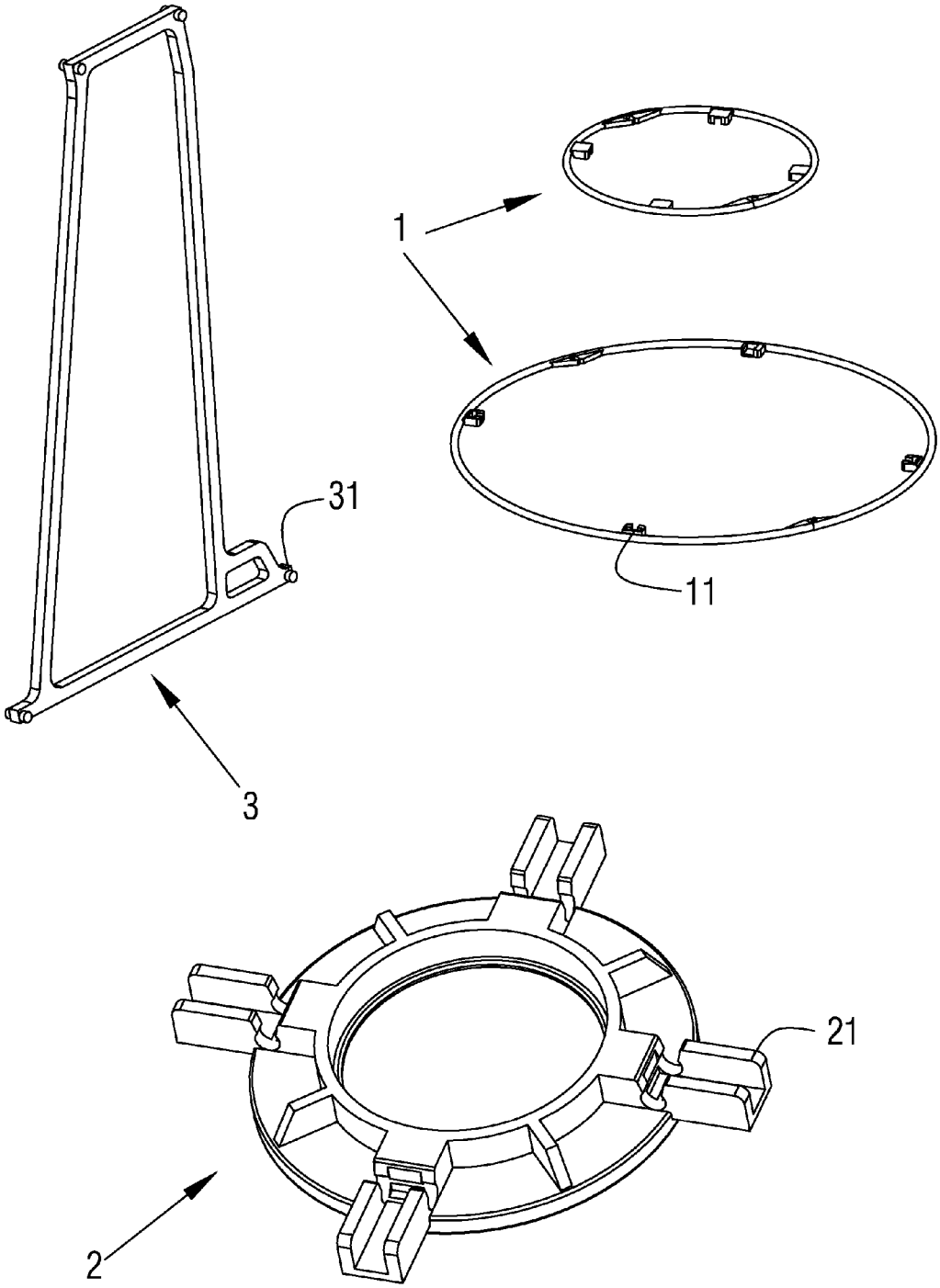
FIG. 1—A view of the included elements separated from the frame for a luminescent screen of the invention.

As shown in the figures, the frame for a luminescent screen, comprising frame elements 1 with a closed contour, a crown 2 and frame members 3 consisting of profiles, with the frame elements 1 being substantially parallel to each other, the circular crown 2 being concentric with respect to one of the frame elements 1, wherein the cap of a bulb can be coupled and inserted into the circular crown, and wherein the frame elements 1 and the circular crown 2 are interconnected and in contact with each other by means of frame members 3, and wherein the frame elements 1, the circular crown 2 and the frame members 3 are coupled to each other by means of couplings, characterized by the fact that the coupling means include a first plurality of receiving elements 11 arranged in the frame elements 1 and oriented towards the inside thereof, a second plurality of receiving elements 21 arranged on the crown 2 and oriented towards the outside thereof, and a plurality of projecting elements 31 in the frame members 3, in such a way that the projecting elements 31 are suitable for inserting and fitting in the different receiving elements 11, 21 of the frame elements 1 and the crown 2.

As can be seen in FIG. 1, the frame for a luminescent screen includes circular frames 1, a circular crown 2 and frame members 3 used as longitudinal beams (in this mode of a preferred embodiment, the frames 1 and the crown 2 are circular, although any other geometric shape would be obvious for an expert in the subject).

Figure 2:
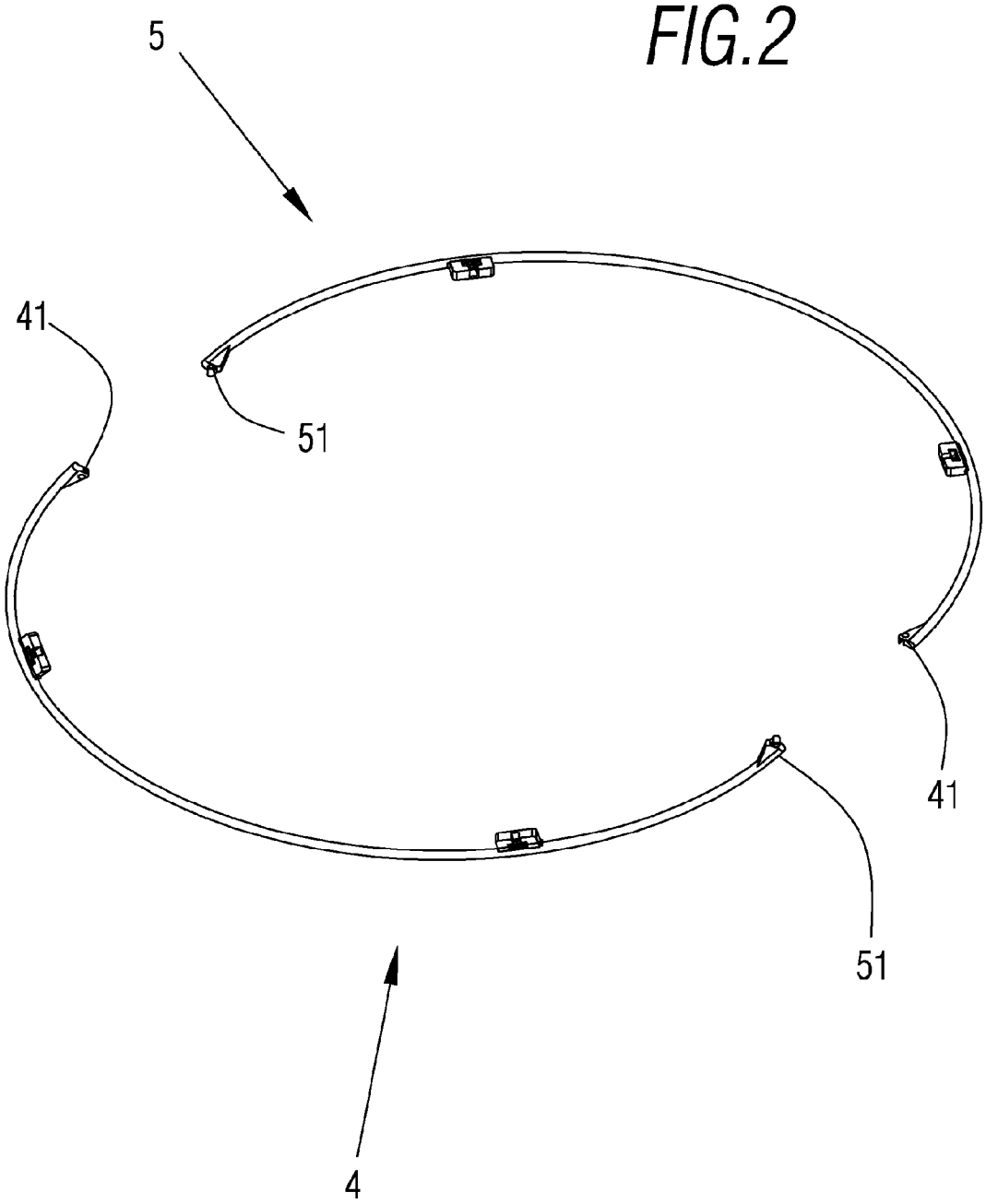
FIG. 2—A view of the parts comprising the frame elements for a luminescent screen of the invention.

As seen in FIG. 2, the frames 1 are in turn comprised of two semi-circular pieces 4 and 5 with male/female connections, which in this modality of a preferred embodiment are embodied by receiving elements 41 and projecting elements 51 located in an alternating manner at their ends and ready to be inserted and fitted together.

The circular crown 2 is designed so that a cap of a bulb can be fitted and inserted in it.

The frames 1, the circular crown 2 and the frame members 3 must be installed and assembled manually by the user, using coupling, characterized because they are comprised of a first plurality of receiving elements 11 located radially along the frames 1, And a second plurality of receiving elements 21, located on the circular crown 2 and protruding outward radially and a plurality of projecting elements 31 in the frame members 3 in a manner that the projecting elements 31 are designed to be inserted and fitted in the receiving elements 11 and 21 of the frames 1 and the circular crown 2.

Once the user has chosen the frame members 3 and frames 1 that are most suitable to their preferences as far as the final features and shape of the lamp (and which in this modality of a preferred embodiment are those shown in FIG. 1), the user must install and assemble it along with the circular crown 2.

To accomplish this, the user must first assemble pieces 4 and 5 that comprise circular frame 1, via the manual insertion of the receiving elements 41 and projecting elements 51 that are present at their ends, as shown in FIG. 3 and thus build selected circular frames 1.

Figure 5:
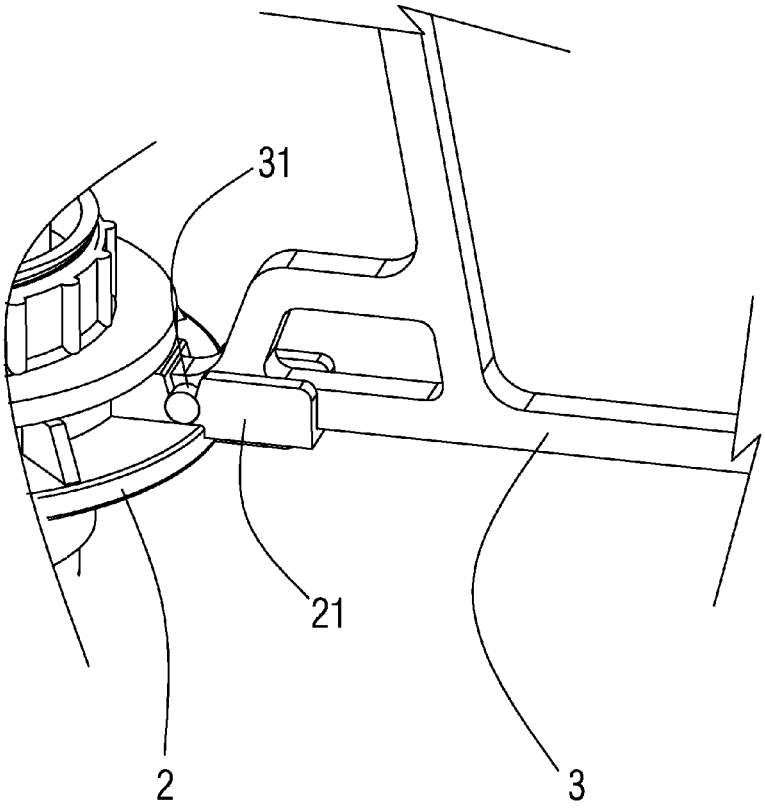
FIG. 5—A detailed view of the coupling between the crown and the frame members for a luminescent screen of the invention.

Once the chosen circular frames 1 are built, the different elements must be assembled, and to accomplish this we must insert the receiving elements 11 and 21 that have been arranged for this purpose on the frames 1 and circular crown 2, as can be seen in the drawing shown in FIG. 4 (for the coupling between frame 1 and the frame members 3), and FIG. 5 (for the coupling between the crown 2 and the frame members 3) and in a manner that the frames 1 are positioned in a substantially parallel manner to them, and the circular crown 2 in a concentric position on the larger frame 1.

Figure 6:
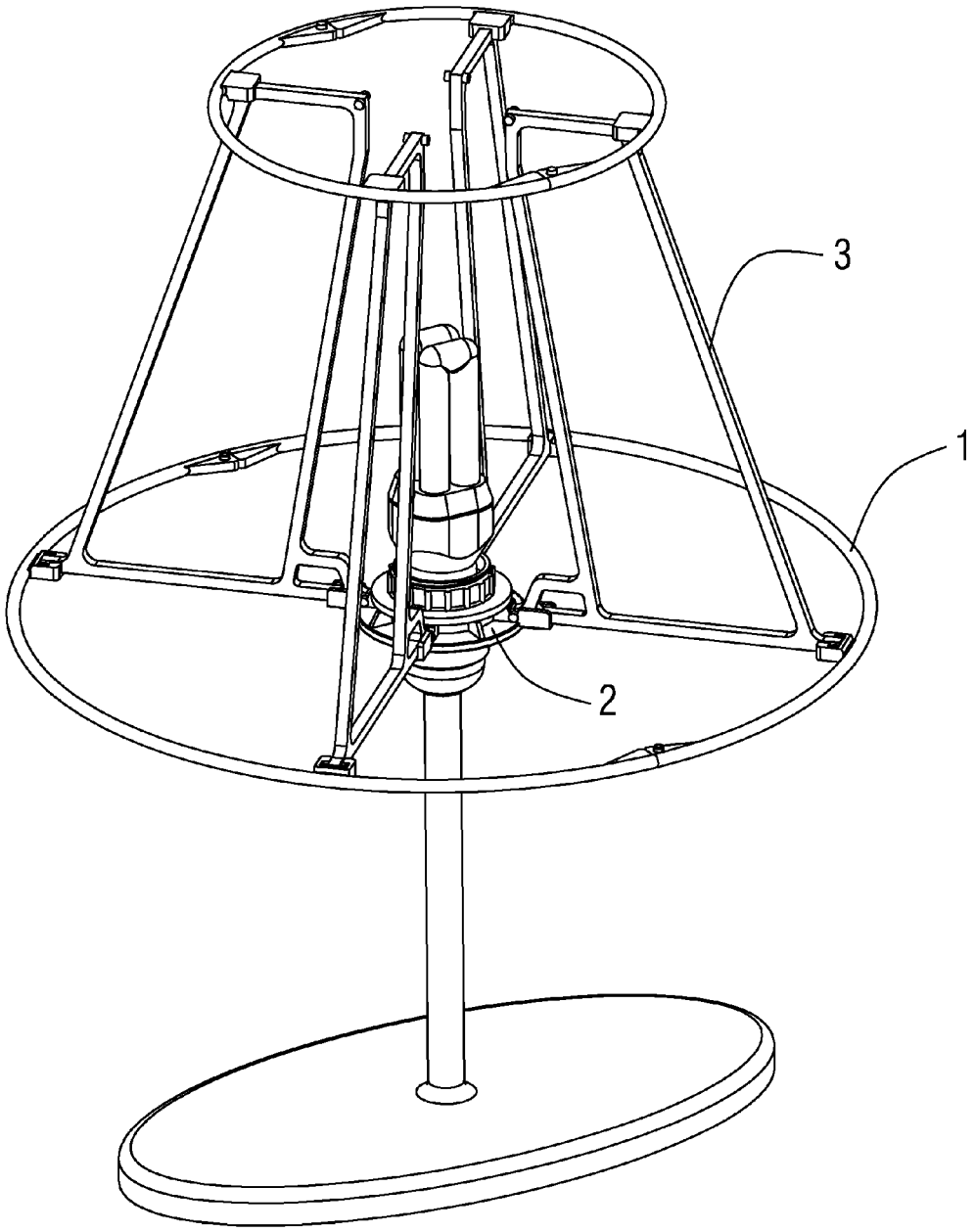
FIG. 6—A view of the frame for a luminescent screen of the invention already assembled.
Figure 7A:
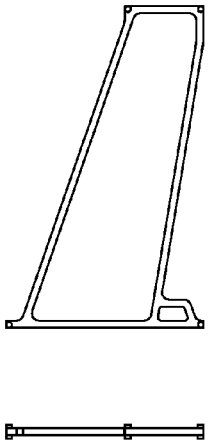
Figure 7B:
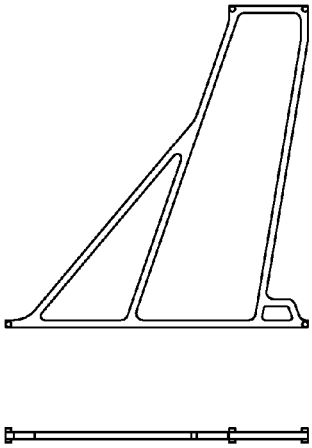
Figure 7C:
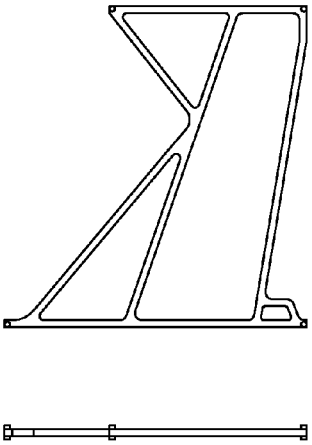
Figure 7D:
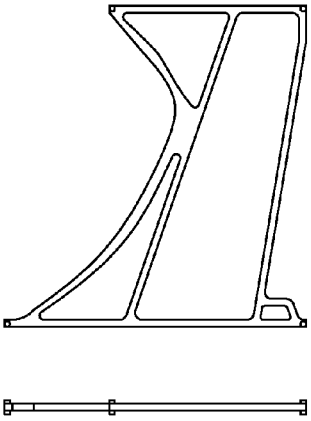
Figure 7E:
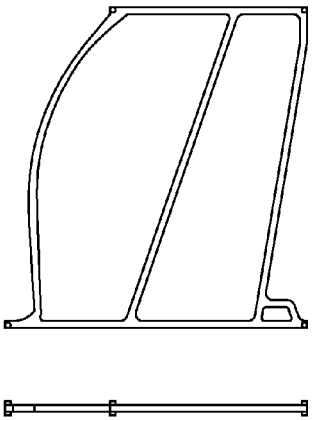
Figure 7F:
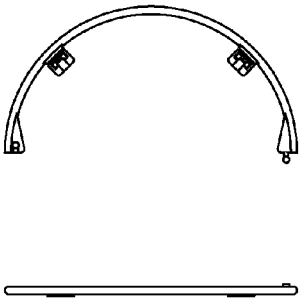
Figure 7G:
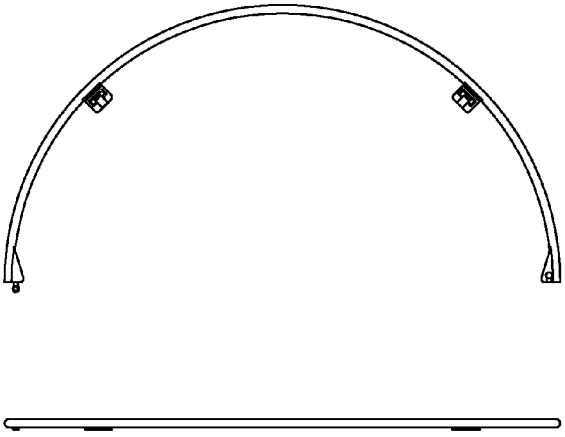
Figure 7H:
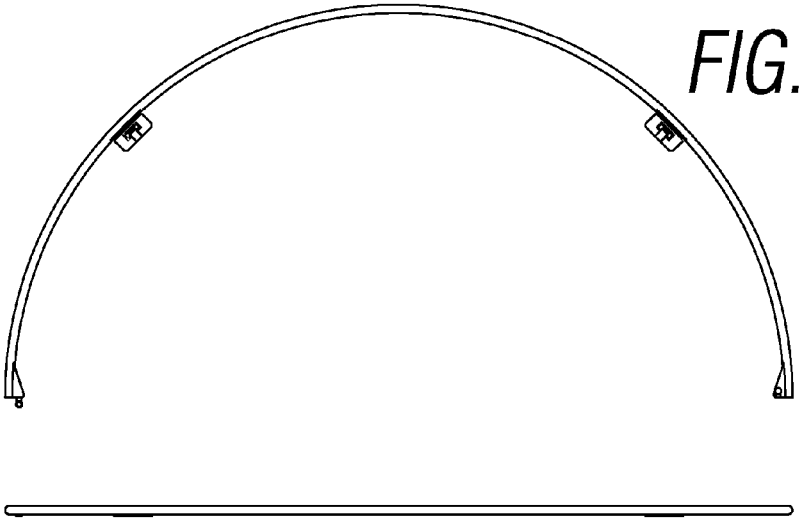

Once the assembling of the frames 1 and circular crown 2 have been accomplished with frame members 3 and in the explained arrangement, the frame will look like the picture shown in FIG. 6 and ready to offer the formal features of a lamp, by inserting the applicable bulb in circular crown 2 and installing the desired screen along the perimeter of the frame 1.

Depending on which different frames 1 and frame members 3 (represented in FIGS. 7*a*-7*j*) are chosen and positioned by the user, the resulting formal features will differ, as shown in FIGS. 8*a*-8*g*, according to the different user preferences.

In addition to this, when the user decides not to use the lamp, the lamp can be easily disassembled and stored in a small package.

Therefore, all operations related with its transport and handling will be made much easier, which also contributes to lower $CO_2$ emissions.

The materials used for the different comprising elements are of the recyclable type.

The details, shapes, dimensions and rest of accessory items, as well as the materials used for manufacturing the frame for the luminescent screen of the invention, may be conveniently replaced with others that are technically equivalent and that do not depart from the essence of the invention or from the scope as defined by the claims provided below.

The invention claimed is:

1. A frame for a luminescent screen, comprising frame elements (1) with a closed contour, a circular crown (2) and frame members (3) consisting of profiles, with the frame elements (1) being substantially parallel to each other, the circular crown (2) being concentric with respect to one of the frame elements (1), wherein the cap of a bulb can be coupled and inserted into the circular crown, and wherein the frame elements (1) and the circular crown (2) are interconnected and in contact with each other by means of frame members (3), and wherein the frame elements (1), the circular crown (2) and the frame members (3) are coupled to each other by means of couplings, characterized by the fact that the coupling means include a first plurality of receiving elements (11) arranged in the frame elements (1) and oriented towards the inside thereof, a second plurality of receiving elements (21) arranged on the crown (2) and oriented towards the outside thereof, and a plurality of projecting elements (31) in the frame members (3), in such a way that the projecting elements (31) are suitable for inserting and fitting in the different receiving elements (11, 21) of the frame elements (1) and the crown (2).

2. The frame for the screen in accordance with claim 1, characterized by the fact that the closed contour frames (1) are comprised of two pieces (4 and 5) coupled to each other, which in turn incorporate male/female connections.

3. The frame for the luminescent screen in accordance with claim 1, characterized by the fact that the frames (1) are made of recyclable materials.

4. The frame for the luminescent screen in accordance with claim 1, characterized by the fact that the circular crown (2) is made of recyclable materials.

5. The frame for the luminescent screen in accordance with claim 1, characterized by the fact that the frame members (3) are made of recyclable materials.

* * * * *